US011247892B2

(12) United States Patent
Moore et al.

(10) Patent No.: US 11,247,892 B2
(45) Date of Patent: Feb. 15, 2022

(54) BEVERAGE DISPENSER FOR DISPENSING LOW SOLUBILITY INGREDIENTS

(71) Applicant: The Coca-Cola Company, Atlanta, GA (US)

(72) Inventors: William J. Moore, Lilburn, GA (US); Susan R. W. Lane, Kennesaw, GA (US); Arthur G. Rudick, Atlanta, GA (US); Indra Prakash, Alpharetta, GA (US); Daniel S. Quartarone, Stone Mountain, GA (US); Jamal Omarl Wilson, Snellville, GA (US); Will Cannon, III, Kennesaw, GA (US)

(73) Assignee: THE COCA-COLA COMPANY, Atlanta, GA (US)

( * ) Notice: Subject to any disclaimer, the term of this patent is extended or adjusted under 35 U.S.C. 154(b) by 40 days.

(21) Appl. No.: 16/471,348

(22) PCT Filed: Dec. 13, 2017

(86) PCT No.: PCT/US2017/066152
§ 371 (c)(1),
(2) Date: Jun. 19, 2019

(87) PCT Pub. No.: WO2018/118594
PCT Pub. Date: Jun. 28, 2018

(65) Prior Publication Data

US 2020/0087132 A1 Mar. 19, 2020

Related U.S. Application Data

(60) Provisional application No. 62/437,194, filed on Dec. 21, 2016.

(51) Int. Cl.

| | |
|---|---|
| ***B67D 1/00*** | (2006.01) |
| ***B67D 1/07*** | (2006.01) |
| ***B67D 1/08*** | (2006.01) |

(52) U.S. Cl.
CPC ..... *B67D 1/0046* (2013.01); *B67D 1/0016* (2013.01); *B67D 1/0021* (2013.01);
(Continued)

(58) Field of Classification Search
CPC .. B67D 1/0043; B67D 1/0044; B67D 1/0046; B67D 1/0047; B67D 1/0048;
(Continued)

(56) References Cited

U.S. PATENT DOCUMENTS 5,758,571 A * 6/1998 Kateman ..... A23G 9/04 99/455
2006/0286262 A1 12/2006 Stearns et al.
(Continued)

FOREIGN PATENT DOCUMENTS

| | | |
|---|---|---|
| WO | 2007/087611 A1 | 8/2007 |
| WO | 2011082257 A2 | 7/2011 |
| WO | 2014/036117 A1 | 3/2014 |

OTHER PUBLICATIONS

International Search Report and Written Opinion, PCT/US2017/066152, dated Mar. 29, 2018 (13 pp.).
(Continued)

*Primary Examiner* — J C Jacyna
(74) *Attorney, Agent, or Firm* — Eversheds Sutherland (US) LLP

(57) ABSTRACT

The present application provides a beverage dispensing system for dispensing beverages with low solubility ingredients. The beverage dispensing system may include a sweetener flow, a first diluent flow, a low solubility ingredient premixing system for mixing a low solubility ingredient with a second diluent flow to create a mixed flow, and a nozzle to mix the sweetener flow, the first diluent flow, and the mixed flow.

18 Claims, 5 Drawing Sheets

(52) U.S. Cl.
CPC ..... *B67D 1/0047* (2013.01); *B67D 1/07* (2013.01); *B67D 1/0862* (2013.01); *B67D 1/0895* (2013.01); *B67D 2210/00125* (2013.01)

(58) Field of Classification Search
CPC ..... B67D 1/005; B67D 2210/0012; B67D 2210/016; B67D 2210/0016
See application file for complete search history.

(56) References Cited

U.S. PATENT DOCUMENTS

2007/0267441 A1* 11/2007 van Opstal ..... B67D 1/0857 222/129.4
2008/0041876 A1* 2/2008 Frank ..... B67D 1/0048 222/1
2010/0089948 A1 4/2010 Ziesel et al.
2011/0111115 A1* 5/2011 Shi ..... A23L 27/36 426/658
2011/0121032 A1* 5/2011 Deo ..... B67D 1/0032 222/145.1
2012/0160871 A1 6/2012 Carpenter et al.
2014/0212564 A1* 7/2014 Zhang ..... A23L 3/358 426/575
2015/0210522 A1* 7/2015 Jersey ..... B67D 1/0034 222/1
2016/0009539 A1* 1/2016 Jersey ..... B67D 1/0044 222/460
2016/0100709 A1* 4/2016 Rudick ..... B67D 1/07 366/182.2
2016/0318746 A1* 11/2016 Peirsman ..... B67D 1/005
2019/0246669 A1* 8/2019 Mehta ..... A23L 2/52

OTHER PUBLICATIONS

Extended EP Search Report, EP 17884869.3, dated Jun. 30, 2020 (9 pp.).

* cited by examiner

BEVERAGE DISPENSER FOR DISPENSING LOW SOLUBILITY INGREDIENTS

TECHNICAL FIELD

The present application and the resultant patent relate generally to beverage dispensers and more particularly relate to beverage dispensers capable of dispensing low solubility ingredients such as powdered solids, highly viscous fluids, and the like.

BACKGROUND OF THE INVENTION

Current post-mix beverage dispensing systems generally mix streams of syrup, concentrate, sweetener, bonus flavors, other types of flavorings, and/or other ingredients with water or other types of diluents by flowing the syrup stream down the center of the nozzle with the water stream flowing around the outside. The syrup stream is directed downward with the water stream such that the streams mix as they fall into a consumer's cup. There is a desire for a beverage dispensing system as a whole to provide as many different types and flavors of beverages as may be possible in a footprint that may be as small as possible. Recent improvements in beverage dispensing technology have focused on the use of micro-ingredients. With micro-ingredients, the traditional beverage bases may be separated into their constituent parts at much higher dilution or reconstitution ratios. These micro-ingredients then may be stored in much smaller packages and stored closer to, adjacent to, or within the beverage dispenser itself The beverage dispenser preferably may provide the consumer with multiple beverage options as well as the ability to customize the beverage as desired.

In addition to micro-ingredients, there is a further desire for a beverage dispensing system to accommodate different types of low solubility ingredients. These low solubility ingredients may include highly viscous fluids such as different types of viscous sweeteners or different types of solids such as solids or crystals. Generally described, these low solubility ingredients may have unstable properties in solution, i.e., the ingredients may precipitate out of solution, change viscosity, crystalize, may become microbiologically unstable, and the like. More specifically, such low solubility ingredients may have a solubility of three percent (3%) by weight or less and in some instances with a solubility of one percent (1%) by weight or less. Some examples of low solubility ingredients for a beverage dispenser may include Sorbic Acid, Caffeine, Reb A, Reb M, other steviol glycosides.

There is thus a desire for a beverage dispensing system that may accommodate such low solubility ingredients. The beverage dispensing system preferably may accommodate this variety of ingredients while still providing good mixing and easy cleaning.

SUMMARY OF THE INVENTION

The present application and the resultant patent thus provide a beverage dispensing system for dispensing beverages with low solubility ingredients. The beverage dispensing system may include a sweetener flow, a first diluent flow, a low solubility ingredient premixing system for mixing a low solubility ingredient with a second diluent flow to create a mixed flow, and a nozzle to mix the sweetener flow, the first diluent flow, and the mixed flow.

The present application and the resultant patent further provide a method of producing a beverage with low solubility ingredients. The method may include the steps of flowing a first diluent to a nozzle, flowing a sweetener to the nozzle, flowing a low solubility ingredient to a low solubility ingredient mixing chamber, flowing a second diluent to the low solubility ingredient mixing chamber, mixing the low solubility ingredient and the second diluent to create a mixed flow, flowing the mixed flow to the nozzle, and mixing the first diluent, the sweetener, and the mixed flow about the nozzle to create the beverage.

The present application and the resultant patent further provide a beverage dispensing system. The beverage dispensing system may include a sweetener flow, a first diluent flow, a low solubility ingredient premixing system for a low solubility ingredient and a second flow of diluent, and a nozzle.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
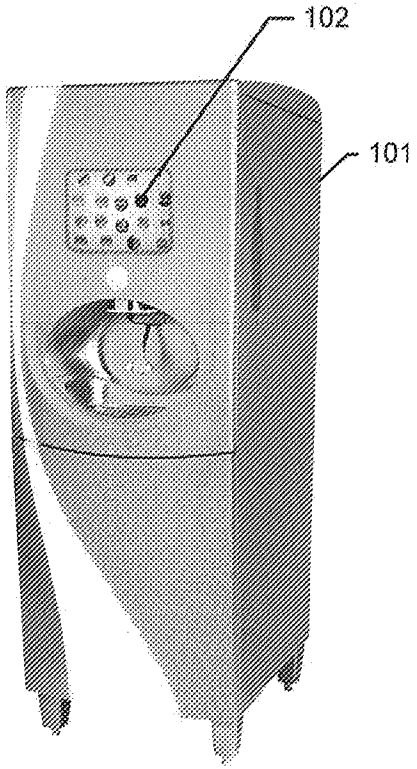
FIG. 1 is a perspective view of a beverage dispensing system as may be described herein.

Referring now to the drawings, in which like numerals refer to like elements throughout the several views, FIG. 1 shows an example of a beverage dispensing system 100 as may be described herein. The beverage dispensing system 100 may be used with diluents, macro-ingredients, micro-ingredients, and other types of ingredients in liquid, solid, or gaseous form to create any number of different types of beverages. The diluents generally include plain water (still water or non-carbonated water), carbonated water, and other fluids.

Generally described, the macro-ingredients may have reconstitution ratios in the range from full strength (no dilution) to about six (6) to one (1) (but generally less than about ten (10) to one (1)). The macro-ingredients may include sugar syrup, HFCS ("High Fructose Corn Syrup"), FIS ("Fully Inverted Sugar"), MIS ("Medium Inverted Sugar"), concentrated extracts, purees, and similar types of ingredients. Other ingredients may include traditional BIB ("bag-in-box") flavored syrups, nutritive and non-nutritive sweetener blends, juice concentrates, dairy products, soy, and rice concentrates. Similarly, a macro-ingredient base product may include the sweetener as well as flavorings, acids, and other common components of a beverage syrup. The beverage syrup with sugar, HFCS, or other macro-ingredient base products generally may be stored in a conventional bag-in-box container remote from the dispenser. The viscosity of the macro-ingredients may range from about 1 to about 10,000 centipoise and generally over 100 centipoises or so when chilled. Other types of macro-ingredients may be used herein.

The micro-ingredients may have reconstitution ratios ranging from about ten (10) to one (1) and higher. Specifically, many micro-ingredients may have reconstitution ratios in the range of about 20:1, to 50:1, to 100:1, to 300:1, or higher. The viscosities of the micro-ingredients typically range from about one (1) to about six (6) centipoise or so, but may vary from this range. Examples of micro-ingredients include natural or artificial flavors; flavor additives; natural or artificial colors; artificial sweeteners (high potency, nonnutritive, or otherwise); antifoam agents, non-nutritive ingredients, additives for controlling tartness, e.g., citric acid or potassium citrate; functional additives such as vitamins, minerals, herbal extracts, nutriceuticals; and over the counter (or otherwise) medicines such as pseudoephedrine, acetaminophen; and similar types of ingredients. Various types of alcohols may be used as either macro- or micro-ingredients. The micro-ingredients may be in liquid, gaseous, or powder form (and/or combinations thereof including soluble and suspended ingredients in a variety of media, including water, organic solvents, and oils). Other types of micro-ingredients may be used herein.

Figure 2:
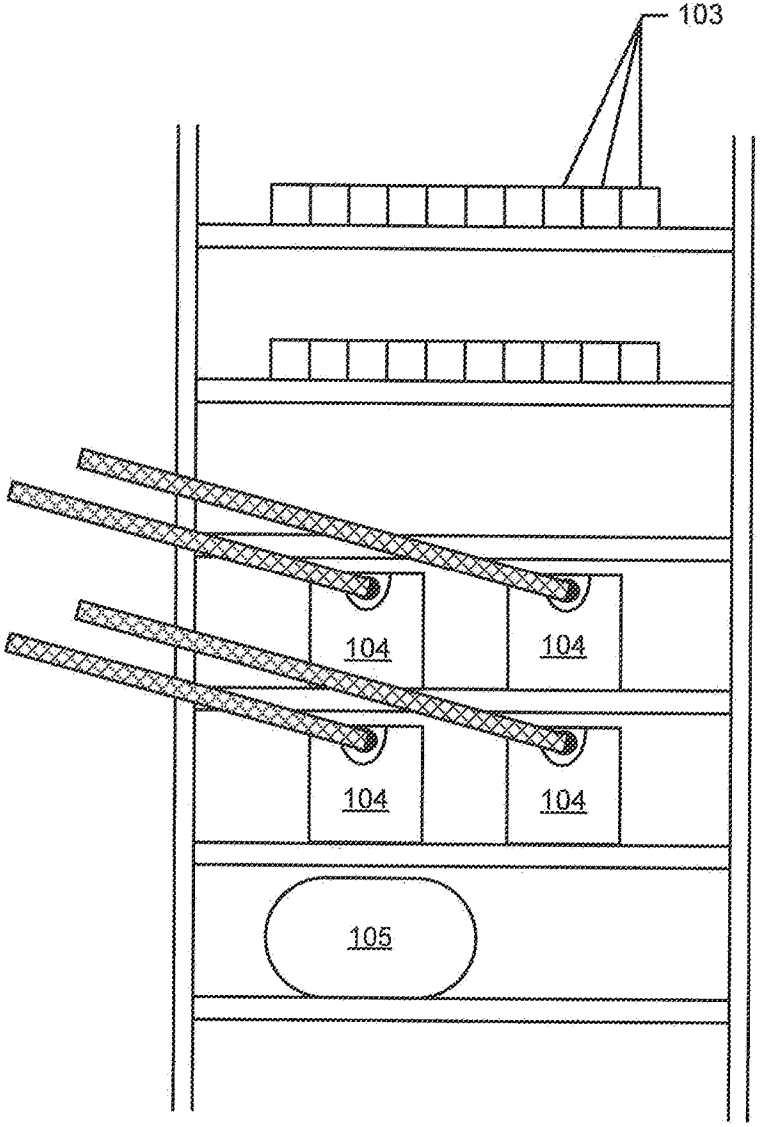
FIG. 2 is a schematic diagram of a back room configuration for use with the beverage dispensing system of FIG. 1.

The beverage dispensing system 100 may include an outer frame 101 and a user interface 102. A consumer may select a beverage via the user interface 102. Likewise, diagnostic information and other types of information may be disclosed on the user interface 102. The micro-ingredients may be stored within the outer frame 101 in cartridges 103 and similar types of containers. As is shown in FIG. 2, legacy ingredients such as conventional syrups and the like in bag-in-box containers 104 and other types of containers may be stored remotely from the out frame 101 in, for example, a back room or other location with the syrups pumped to the beverage dispensing system 100. Other components such as a carbon dioxide source 105 also may be stored remotely. Replacement micro-ingredient cartridges 103 also may be stored remotely and inserted within the outer frame 101 as needed. Other components and other configurations may be used herein.

Figure 3:
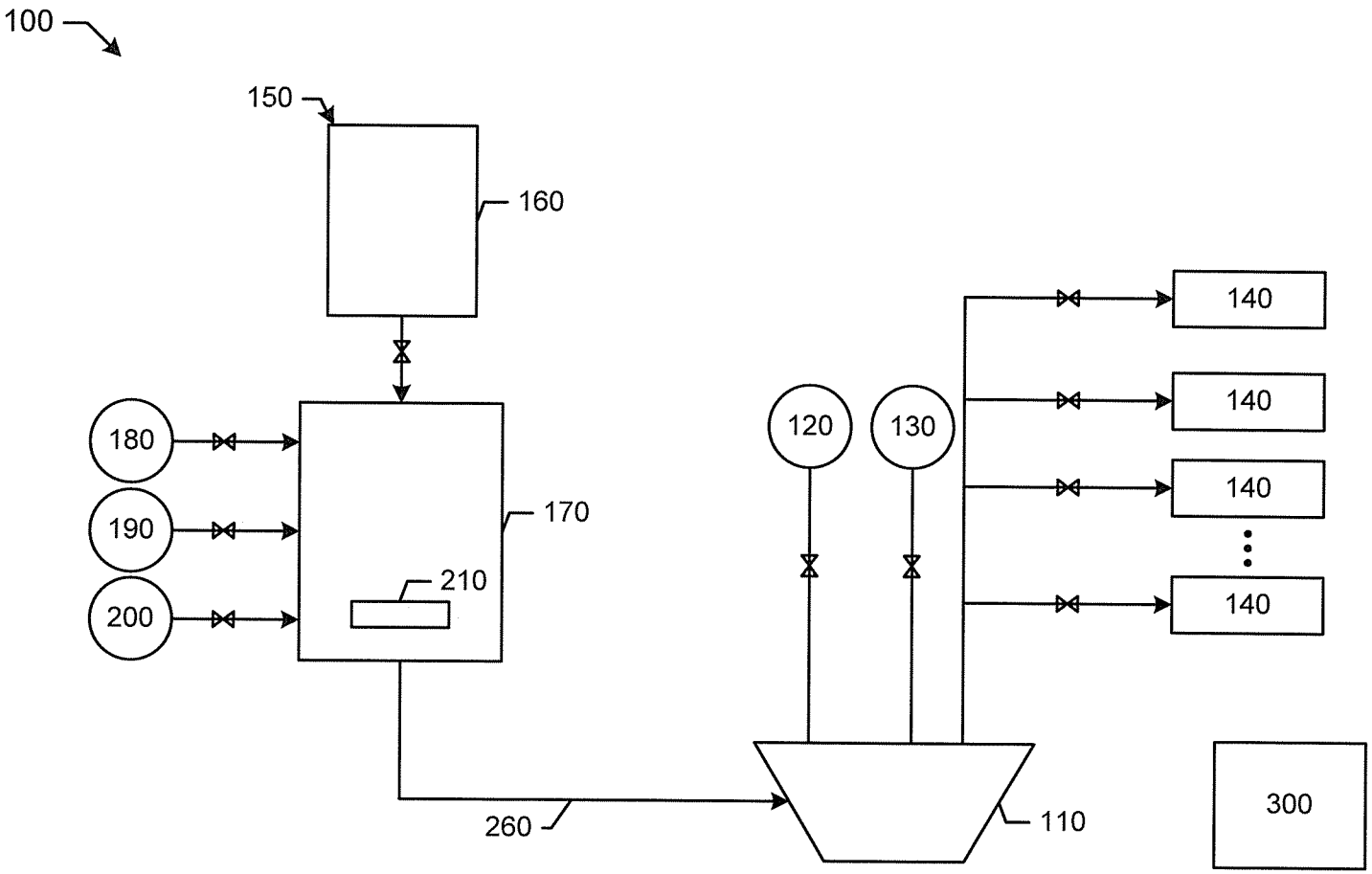
FIG. 3 is a schematic diagram of a beverage dispensing system as may be described herein.

FIG. 3 shows a schematic diagram of examples of the components of the beverage dispensing system 100. These different types of ingredients may be mixed in or about a nozzle 110. The nozzle may be of conventional design and may accommodate ingredients with different viscosities, flow rates, mixing ratios, temperatures, and other variables. The beverage dispensing system 100 thus may have one or more diluent sources 120, one or more macro ingredient sources 130, and any number of micro-ingredient sources 140 in communication with the nozzle 110. A suitable example of the multi-flavor nozzle 110 may be shown in commonly owned U.S. Patent Publication No. 2015/0315006, entitled "Common Dispensing Nozzle Assembly." Other components and other configuration may be used herein.

The beverage dispensing system 100 also may include a low solubility ingredient premixing system 150. As described above, the low solubility ingredients may include any type of ingredient with at least partially unstable properties in solution or otherwise. The low solubility ingredients may be liquid, gas, or solid. Examples may include a sweetener such as stevia, acesulfame potassium, high fructose corn syrup, fully inverted sugars, medium inverted sugars, cane sugar, honey, monk fruit, powdered sugar, and other types of nutritive or high intensity non-nutritive sweeteners. The low solubility ingredients also may include ginger, coconut, chocolate, hazelnut, almond, tarragon, cinnamon, cardamom, brewer's yeast, ginseng, hibiscus, acai berry, spirulina, kambucha, caffeine, mattcha, mocha, coffee, espresso, tea, praline, French vanilla, mint, and the like. Many other types of ingredients may be used herein.

The low solubility ingredient premixing system 150 may include a low solubility ingredient storage chamber 160. The low solubility ingredient storage chamber 160 may be a conventional bulk ingredient hopper, a single serving ingredient pod, or a container with any suitable size, shape, or configuration therebetween. Although only a single low solubility storage chamber 160 is shown, the low solubility ingredient premixing system 150 may have any number of the storage chambers 160 with any number of low solubility ingredients. Other components and other configurations may be used herein.

The low solubility ingredient premixing system 150 also may include a low solubility ingredient mixing chamber 170. The low solubility ingredient mixing chamber 170 may have any suitable size, shape, or configuration. Multiple low solubility ingredient mixing chambers 170 may be used herein. The low solubility ingredient mixing chamber 170 may be in communication with one or more diluent sources 180, one or more dilution additive sources 190, and one or more other ingredient sources 200. The diluent sources 180 may include plain or carbonated water and the like. The diluent additive sources 180 may include, for example, different types of acids in varying concentrations and the like. Different types of additives may be used herein. The other ingredient sources 200 may include different types of micro-ingredients, flavors, colors, or other ingredients of any type.

Figure 4:
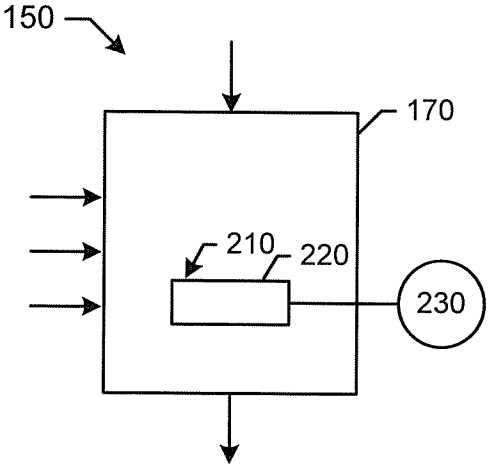
FIG. 4 is a schematic diagram of an alternative embodiment of a beverage dispensing system as may be described herein.

The low solubility ingredient mixing chamber 170 may include one or more low solubility ingredients mixing devices 210 therein. The mixing devices 210 may take many different forms. For example, the low solubility ingredient mixing device 210 may be a static mixer without any moving parts. Alternatively as is shown in FIG. 4, the low solubility mixing devices 210 may be a mechanical mixer 220. The mechanical mixer 220 may be an auger, an impeller, a blender, a stirrer, a whisk, a blade, a roller, or any type of mechanical device that creates agitation within the mixing chamber 170. The mechanical mixer 220 may be driven by a motor 230. The motor 230 may be an electrical motor or any type of driving device. The mixing devices 210 also may include a recirculation system. Acoustic or electrically stimulated mixing also may be used herein. Other components and other configurations may be used herein.

Figure 5:
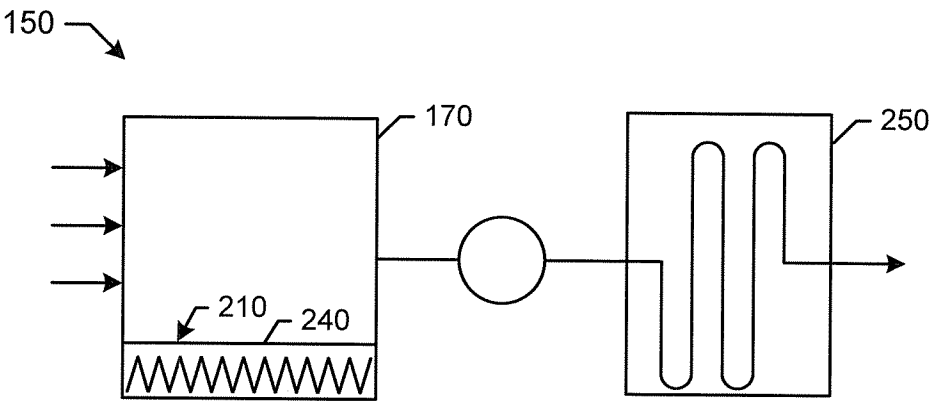
FIG. 5 is a schematic diagram of an alternative embodiment of a beverage dispensing system as may be described herein.

The low solubility mixing device 210 also may take the form of a heating device 240. As is shown in FIG. 5, the heating device 240 may include a conventional heating coil and the like. The heating device 240 may be any type of heating device that raises the temperature of the ingredients within the low solubility mixing chamber 170. The heating device 240 optionally may be used with a cold plate 250 and the like positioned downstream of the nozzle 110. The cold plate 250 may be of conventional design. Other components and other configurations may be used herein. Different types of low solubility mixing devices 210 may be used herein together, i.e., the mechanical mixer 220 and the heating device 240.

In use, an amount of a low solubility ingredient may be dispensed from the low solubility ingredient storage chamber 160 into the low solubility mixing chamber 170. At the same time, diluents from the diluent sources 180, additives from the diluent additive sources 190, and/or other ingredients from the other ingredient sources 200 also may be supplied to the low solubility ingredient mixing chamber 170. The low solubility ingredient mixing device 210 then mixes the low solubility ingredients, the diluents, the diluent additives, and/or the other ingredients to create a mixed flow 260. Preferably, the mixed flow 260 may have a viscosity of about 100 centipoise or less and may have particulates of less than about 0.3 micron therein. If the heating device 240 is used, the heating device 240 may heat the low solubility mixing chamber 170 to more than about eighty (80) degrees Celsius or so for microbiological stability. The cold plate 250 then may chill the mix flow 260 to a temperature of about two (2) to five (5) degrees Celsius so as to prevent carbon dioxide break out during the post mix process. Other temperatures may be used herein. The diluent additives such as an acid may provide further microbiological stability. Other components and other configurations may be used herein.

The mixed flow 260 then may be forwarded to the nozzle 110. The mixed flow 260 may be mixed with any number of the micro-ingredients, the sweetener or macro-ingredients, and further flows of the diluent in or about the nozzle 110. Multiple low solubility ingredient premixing systems 150 may deliver multiple low solubility ingredients to the nozzle 110.

Figure 6:
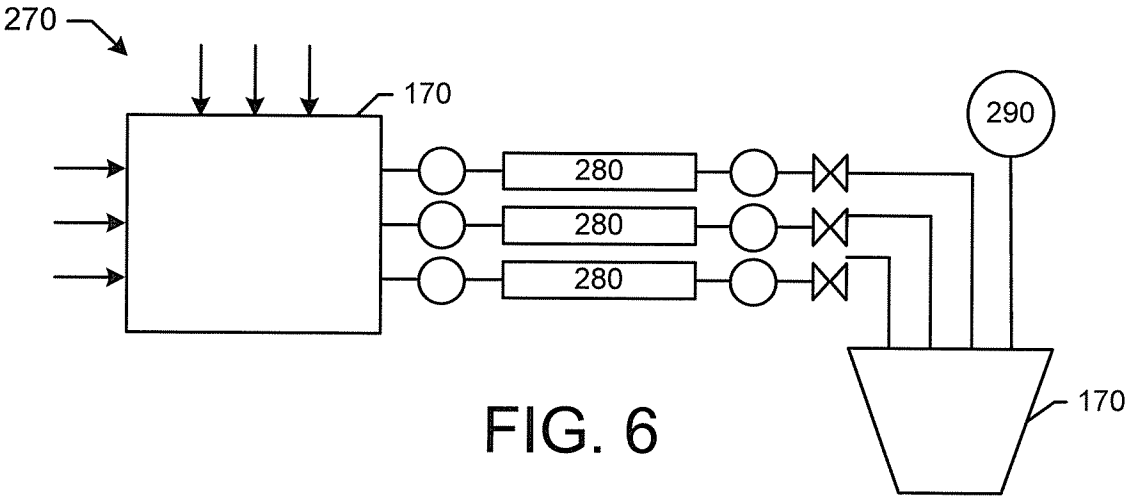
FIG. 6 is a schematic diagram of an alternative embodiment of a beverage dispensing system as may be described herein.

FIG. 6 shows a further embodiment of a low solubility ingredient premixing system 270. In this example, the low solubility ingredient premixing system 270 may include a number of storage containers 280. The storage containers 280 may be positioned between the low solubility ingredient mixing chamber 170 and the nozzle 110. The storage containers 280 may have any suitable size, shape, or configuration. The use of the storage containers 280 ensures that a sufficient volume of the mixed flow 260 is available during, for example, high volume dispensing periods. The storage containers 280 and the nozzle 110 may be used in connection with a flush system 290. After each dispense and/or after the mixed flow 260 has reached an expiration time within the storage containers 280, the flush system 290 may flush the system with a water flow and the like. Other types of cleaning system and methods may be used herein. Other components and other configurations may be used herein.

Figure 7:
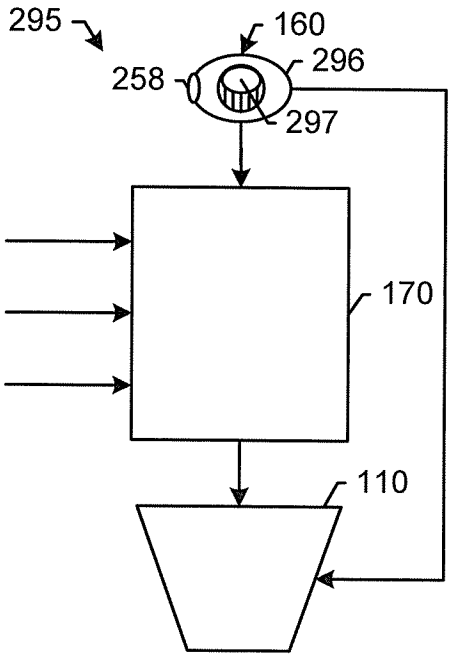
FIG. 7 is a schematic diagram of an alternative embodiment of a beverage dispensing system as may be described herein.

FIG. 7 shows a further embodiment of a low solubility ingredient premixing system 295. In this example, the low solubility ingredient storage chamber 160 may take the form of a single serving chamber 296 in communication with either the low solubility ingredient mixing chamber 170 or the nozzle 110 (if pre-mixing is not required). The single serving chamber 296 may be used with a single serving pod or pouch 297. Other types of containers may be used herein. The single serving chamber 296 may have an entry slot 258 for inserting the single serving pod or pouch 297 therein. The single serving pod or pouch 297 may be evacuated by conventional means including gravity, pressure, vacuum, piston, pump, and the like. The single serving chamber 296 thus may forward micro-ingredients and the like to the low solubility ingredient mixing chamber 170 or macro-ingredients and the like to the nozzle 110. Other components and other configurations may be used herein.

The beverage dispensing system 100 may include different types of pumps, valves, flow meters, and/or other types of fluid control devices. The overall operation of the beverage dispensing system 100 may be governed by a controller 300. The controller 300 may be any type of programmable logic device with conventional input devices, output devices, memory, operating systems, and communication systems. The controller 300 may be local or remote. Any number of controllers 300 may be used herein.

Figure 8:
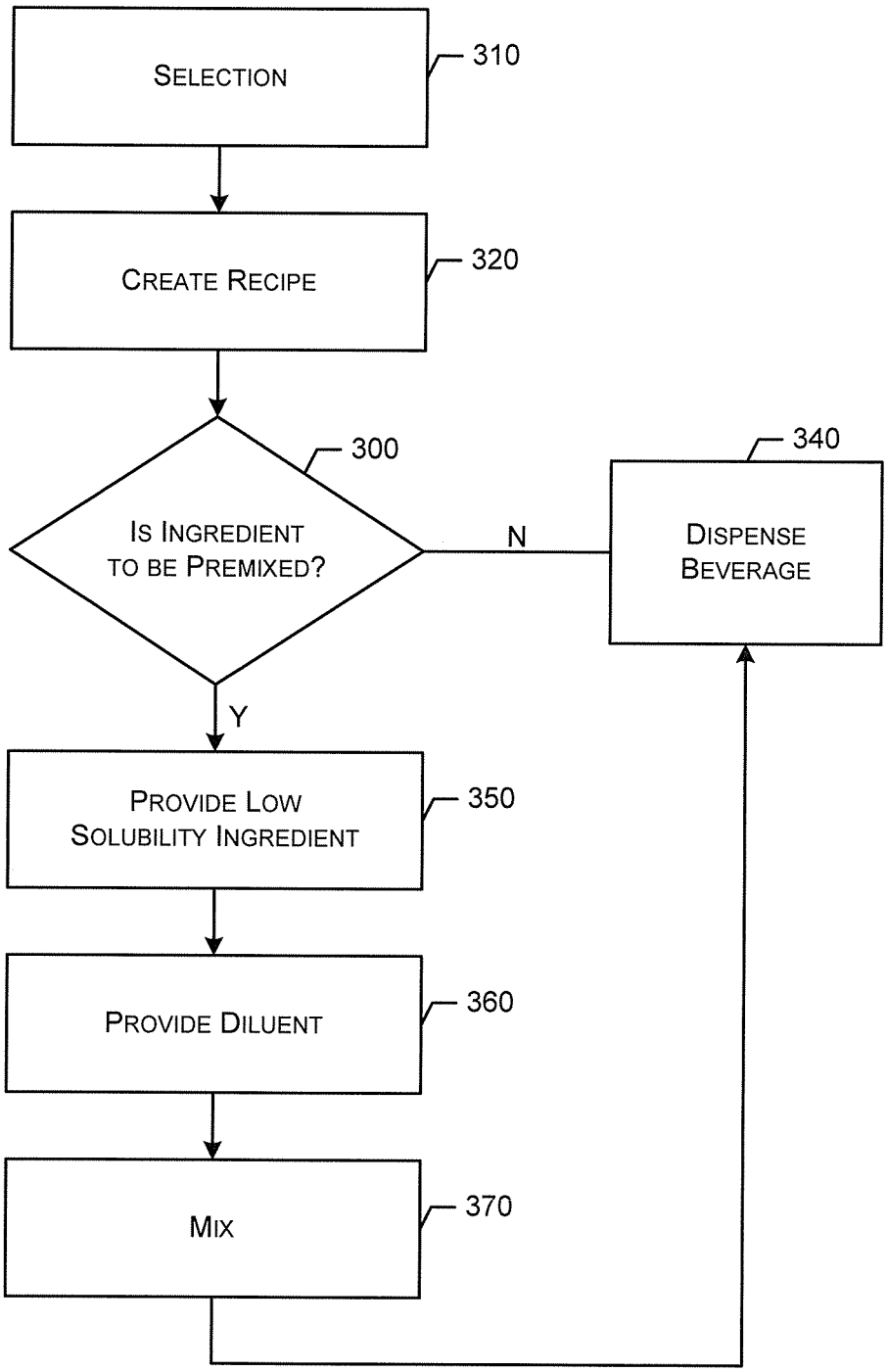
FIG. 8 is a flow chart showing exemplary method steps in the use of a beverage dispensing system as may be described herein.

FIG. 8 shows exemplary method steps in the operation of the beverage dispensing system 100. At step 310, a user may select a beverage and/or specific ingredients. At step 320, the controller 300 may create the appropriate recipe with the selected ingredients. At step 330, the controller may determine if the ingredient is to be pre-mixed. If so, the selected the ingredient may be dispensed at step 340. If premixing is required, the controller 300 may open the low solubility ingredient storage chamber 160 at step 350 and may open the diluent sources 180 at step 360. At step 370, the ingredients and the diluent and other ingredients may be mixed within the low solubility mixing chamber 170. The mixed flow 280 then may be pumped to the nozzle 110 for dispensing.

In the context of beverage dispensing systems, solubility should be described as solubility in water at temperatures between about 0-50 degrees Celsius. Typical finished beverage temperatures of dispensed beverages may be in the range of about 3-10 degrees Celsius such that the temperature of the low solubility ingredient solution should be managed so as to not increase the temperature of the finished beverage by more than about 1-3 degrees Celsius or to cause excessive breakout of carbonation in carbonated beverages while still preventing precipitation of the low solubility ingredients therein.

The beverage dispensing system 100 thus provides the ability to properly mix and dispense any type of low solubility ingredient. The beverage dispensing system 100 thus may accommodate highly viscous fluids, powders, and other types of solids and mix these ingredients into a dispensable form with appropriate viscosity and low particulates.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalence thereof.

We claim:

1. A beverage dispensing system for dispensing beverages with low solubility ingredients, comprising:

a sweetener flow;

a first diluent flow;

an undiluted first micro-ingredient flow;

a low solubility ingredient premixing system;

wherein the low solubility ingredient premixing system mixes a low solubility second micro-ingredient having a solubility of three percent by weight or less with a second diluent flow to create a mixed flow; and a nozzle to mix the sweetener flow, the undiluted first micro-ingredient flow, the first diluent flow, and the mixed flow.

2. The beverage dispensing system of claim 1, further comprising a plurality of undiluted first micro-ingredient flows.

3. The beverage dispensing system of claim 2, wherein the plurality of undiluted first micro-ingredient flows are mixed with the sweetener flow, the first diluent flow, and the mixed flow at the nozzle.

4. The beverage dispensing system of claim 1, wherein the low solubility ingredient premixing system comprise a low solubility ingredient storage chamber with a volume of the low solubility micro-ingredient therein.

5. The beverage dispensing system of claim 1, wherein the low solubility ingredient premixing system comprises a low solubility ingredient mixing chamber.

6. The beverage dispensing system of claim 5, wherein the low solubility ingredient mixing chamber is in communication with one or more diluent sources.

7. The beverage dispensing system of claim 5, wherein the low solubility ingredient mixing chamber is in communication with one or more diluent additive sources.

8. The beverage dispensing system of claim 5, wherein the low solubility ingredient mixing chamber is in communication with one or more storage containers.

9. The beverage dispensing system of claim 5, wherein the low solubility ingredient mixing chamber comprises a low solubility ingredient mixing device.

10. The beverage dispensing system of claim 9, wherein the low solubility ingredient mixing device comprises a static mixer.

11. The beverage dispensing system of claim 9, wherein the low solubility ingredient mixing device comprises a mechanical mixer.

12. The beverage dispensing system of claim 9, wherein the low solubility ingredient mixing device comprises a heating device.

13. The beverage dispensing system of claim 12, further comprising a cold plate downstream of the heating device.

14. The beverage dispensing system of claim 1, further comprising a flush system in communication with the nozzle.

15. A method of producing a beverage with low solubility ingredients, comprising:

flowing a first diluent to a nozzle;

flowing a sweetener to the nozzle;

flowing an undiluted first micro-ingredient to the nozzle;

flowing a low solubility second micro-ingredient having a solubility of three percent by weight or less to a low solubility ingredient mixing chamber;

flowing a second diluent to the low solubility ingredient mixing chamber;

mixing the low solubility second micro-ingredient and the second diluent to create a mixed flow;

flowing the mixed flow to the nozzle; and mixing the first diluent, the sweetener, the undiluted first micro-ingredient, and the mixed flow about the nozzle to create the beverage.

16. The beverage dispensing system of claim 1, wherein the low solubility second micro-ingredient comprises steviol glycosides.

17. The beverage dispensing system of claim 16, wherein the steviol glycosides comprise Reb A and Reb M.

18. The beverage dispensing system of claim 1, wherein the low solubility second micro-ingredient comprises one or more of a nutritive sweetener and a non-nutritive sweetener.

* * * * *